United States Patent [19]

Moen

[11] 4,066,422

[45] Jan. 3, 1978

[54] WEAR-RESISTANT COMPOSITE MATERIAL AND METHOD OF MAKING AN ARTICLE THEREOF

[75] Inventor: Lowell J. Moen, Peoria, Ill.

[73] Assignee: Caterpillar Tractor Co., Peoria, Ill.

[21] Appl. No.: 618,854

[22] Filed: Oct. 2, 1975

[51] Int. Cl.[2] ..... B24D 3/08

[52] U.S. Cl. ..... 51/309 R; 75/.5 BA; 428/614

[58] Field of Search ..... 75/.5 BA, 126 P, 123 B, 75/176; 51/309; 428/614, 627

[56] References Cited

U.S. PATENT DOCUMENTS

| | | | |
|---|---|---|---|
| 1,562,042 | 11/1925 | Pacz | 75/126 P |
| 3,293,012 | 12/1966 | Smiley et al. | 51/309 |
| 3,372,010 | 3/1968 | Parsons | 51/309 |
| 3,635,699 | 1/1972 | Chadwick | 75/.5 BA |
| 3,791,818 | 2/1974 | Watmough | 75/126 P |
| 3,800,891 | 4/1974 | White et al. | 175/374 |
| 3,970,445 | 7/1976 | Gale et al. | 75/.5 BA |

FOREIGN PATENT DOCUMENTS

| | | | |
|---|---|---|---|
| 1,338,140 | 11/1973 | United Kingdom | 51/309 |

*Primary Examiner*—Donald J. Arnold
*Attorney, Agent, or Firm*—Charles E. Lanchantin, Jr.

[57] ABSTRACT

A wear-resistant composite material and method of making an article thereof is disclosed which is particularly adaptable for use with a ground-engaging tool. The composite material has a plurality of abrasive-resistant particles embedded in an iron-boron matrix.

10 Claims, No Drawings

WEAR-RESISTANT COMPOSITE MATERIAL AND METHOD OF MAKING AN ARTICLE THEREOF

BACKGROUND OF THE INVENTION

Considerable research effort has been devoted to improving the wear properties of tools and the like through material development. Most promising are those efforts involving material composites for tool hard facings or inserts, and which composites embody bonding of a plurality of highly abrasive-resistant particles in a carrying matrix. Illustrative of these composite materials are U.S. Pat. No. 3,800,891, issued to A. D. White, et al on Apr. 2, 1974; British Pat. No. 1,338,140 published Nov. 21, 1973; U.S. Pat. No. 3,970,445 issued July 20, 1976 to P. L. Gale, et al; and U.S. Pat. No. 4,011,051 issued Mar. 8, 1977 to E. L. Helton et al. It is noted that both of the aforementioned patent applications are assigned to the assignee of the present invention.

In general, prior composite materials such as those mentioned above have been relatively expensive due to the cost of the individual elements thereof, or due to the complexity of the manufacturing process associated therewith. Naturally, such costs must be measured against the extended wear life gained by utilizing the new composite material in place of the old.

When these composite materials are used for ground-engaging tools, for example, the need for certain physical qualities in the material become readily apparent. In such a working environment, many of the known wear-resistant alloys are found to be unsuitable since they are so hard that they are brittle and, therefore, are not resistant to the frequent shocks encountered. Particularly, the abrasive-resistant particle carrying matrix must be tough and shock resistant, and yet be hard enough to exhibit a relatively low rate of wear.

Furthermore, it is highly desirable that articles of the wear-resistant composite material be capable of being joined to a substrate by brazing or welding. Heretofore, this has presented a problem in that the physical qualities of the composite material have been impaired by the heat utilized during this joining stage, or in the subsequent heat treating operation of the substrate itself.

SUMMARY AND OBJECTS OF THE INVENTION

Accordingly, it is an object of the present invention to provide an improved wear-resistant composite material for a tool or the like, which has a low cost to wear-life ratio.

Another object of the present invention is to provide such a composite material having the ability to closely embrace and carry a plurality of highly abrasive-resistant particles, as well as having the proper balance of hardness and shock resistance.

Another object is to provide a composite material of the character described which has a matrix that will retain its metallurgical and/or physical structure without being adversely affected by subsequent brazing or heat treatment operations associated with its attachment to a substrate.

Other objects and advantages of the present invention will become more readily apparent upon reference to the following description.

DESCRIPTION OF THE BASIC EMBODIMENT

In accordance with the present invention a wear-resistant composite material is provided which is particularly adaptable to a ground-engaging tool such as the cutting edge of a motor grader. Such composite material includes a plurality of highly abrasive-resistant particles which are embedded in an iron-boron matrix.

The abrasive-resistant particle portion of the present invention is preferably a relatively low-carbon, chromium-iron based alloy having a predetermined amount of boron therein. More particularly, the chemical composition of this alloy in percent by weight is set forth below:

Chromium; 25 - 70%
Boron; 6 - 12%
Silicon; less than 2%
Carbon; less than 0.2%
Iron; remainder This combination of elements, in the proportions indicated, gives a complex mixture of iron and chromium borides having extremely high hardness values, typically from about 1200 to about 1600 Kg/mm Knoop (or above about 70 on the Rockwell "C" hardness scale). Preferably this mixture is formed into semi-round or spheroidal particles, hereinafter also referred to as extremely hard shot, having diameters within the range of from 0.5 mm (0.02 inch) to 2 mm (0.08 inch) and a melting temperature in the range of from 1232° C (2250° F) to 1899° C (3450° F). While such extremely hard shot may be made by almost any conventional method, it is to be noted that its extreme hardness is at least in part due to its relatively fine microstructure. This microstructure is attributable to rapid cooling and solidification of melted droplets into spheres as the droplets are exposed to a suitable cooling liquid.

It is to be noted that the preferred extremely hard shot portion of the present invention is claimed in U.S. Pat. No. 3,970,445 and which patent was previously mentioned above. However, it should be appreciated that while it is advantageous to use such shot in the composite material of the present invention, other extremely abrasive-resistant materials may be used with the improved matrix material portion of the present invention. Preferably, these other materials would be ferrous-based alloys having a carbon content limited to less than 0.2% for reasons which will be set forth later in this application.

Referring now to the particle carrying matrix portion of the present invention, such matrix has been found to exhibit a relatively significant degree of toughness and ductility, while also retaining a substantially high hardness for an extended wear life. This matrix has the following chemical composition in percent by weight:

Boron; 3 - 5%
Carbon; less than 0.2%
Iron; Remainder

Preferably the iron-boron matrix of the present invention is of eutectic composition, wherein the boron is controlled to a level of approximately 3.8%. This eutectic composition provides an alloy having a relatively fine ferritic microstructure and a high average hardness within a range of from 35 to 45 on the Rockwell "C" scale due to boride needles therein. Also, because of the aforementioned range of boron content, the melting temperature thereof is accurately established within a relatively small range of from approximately 1161° C (2122° F) to 1200° C (2200° F).

It is to be understood that the matrix material of the present invention is meltably deposited embracingly around the extremely hard shot. This is achieved at a temperature below the melting point of the extremely hard shot, but in an environment wherein the matrix limitedly erodes and fully wets such shot. The compatibility and ferrous based nature of the matrix material and extremely hard shot is such as to provide a relatively strong bond therebetween.

OPERATION

While the composition and interacting physical structure of the chromium-iron-boron shot and iron-boron matrix portions of the present invention are believed clearly apparent from the foregoing description, further amplification of the relationship thereof will subsequently be made in the following brief summary of such operation. An article may be made of the wear-resistant composite material of the present invention by initially placing a quantity of the chromium-iron-boron shot into a ceramic mold having the desired shape, and then depositing a quantity of the iron-boron alloy material on top thereof for subsequent melting. Preferably, the mix consists essentially of 45 to 70 percent by volume of the extremely hard shot. Furthermore, it has been found to be particularly desirable to deposit the iron-boron alloy material in the mold in the form of spheroidal shot having substantially the same range of diameters as the extremely abrasive-resistant shot, and with the latter remaining substantially physically unchanged during further processing of the composite material.

The ceramic mold and both forms of the shot are then deposited in the chamber of a furnace, and the chamber is subsequently substantially evacuated and/or filled with a high purity inert gas such as argon to provide a generally inert type of atmosphere. At this time a relatively limited amount of nitrogen gas may be introduced into the chamber at a very low pressure to protect the furnace and elements of the composite material from vaporization problems. This nitrogen environment particularly inhibits the evaporation of the chromium and boron.

The furnace chamber and materials are subsequently initially preheated at a temperature of approximately 1093° C (2000° F) for a period of approximately 1 hour in order to obtain a uniform temperature thereof. This minimizes the time required to hold an immediately following final heating temperature of approximately 1204° C (2200° F), which is maintained for approximately 15 to 30 minutes. During the final heating stage the iron-boron alloy shot is melted, with the melt seeping downwardly through gravity to fully infiltrate and encapsulate the chromium-iron-boron shot. This reduced time at final temperature minimizes the erosion of the extremely abrasive-resistant shot by the fully embracing matrix material, and otherwise protects the original physical characteristics thereof.

Another aspect of the present invention which involves the thorough infiltration of the melted matrix material around the extremely hard shot concerns the relative density of both of them. Specifically, the density of the extremely hard shot is 6.5 gms/cc$^3$ and the density of the matrix material is 7.7 gms/cc$^3$, so that beneficially there is a slight tendency of the extremely hard shot to float in the melted matrix material. This density differential results in a limited amount of movement of the shot and this aids in allowing the melt to fill voids around the relatively closely spaced extremely hard shot. Since there is only a slight excess of the matrix after filling the voids, a relatively homogenous and fully embraced arrangement of the unmelted shot is thus provided in the tougher matrix.

Lastly, of course, it is to be understood that the furnace is subsequently cooled and the completed composite article removed from the ceramic mold.

The composite article of the present invention may then be joined to a substrate such as the steel cutting edge of a ground engaging tool. In accordance with one aspect of the invention, such article may be appropriately joined to the substrate by brazing. This is achieved without deleteriously affecting the strength and hardness of either the matrix material or the abrasive-resistant shot. Furthermore, even if the steel of the substrate was weakened by this heating process, then the entire assembly can subsequently be subjected to conventional heat treatment to reharden the substrate without adversely affecting the composite material qualities. In accordance with a feature of the present invention this is in a large part due to the relatively low percentage of carbon which is established in both the abrasive-resistant shot and the matrix material. Furthermore, it is to be noted that a ceramic mold, rather than a graphite mold, is utilized. In this way substantially no carbon contamination of the alloys can take place during the heating phases, nor can relatively high temperatures cause any substantial changes to the microstructure of the composite article. This is in marked contrast to other ferrous alloy materials having higher carbon contents, which are significantly physically modified by heat.

The aforementioned procedure has proven extremely effective in obtaining a less costly wear-resistant composite article than heretofore known, with the abrasive-resistant spheroidal particles thereof retaining an extremely high hardness value of approximately 1400 Kg/mm Knoop and with the matrix material exhibiting a relatively high and typical hardness level of approximately 42 on the Rockwell "C" hardness scale. In accordance with the present invention, a composite material is formed with the abrasive-resistant spheroidal particles thereof being relatively closely spaced in order to block the wear paths which are initiated by abrasive wear of the slightly softer material of the matrix. Test results of the wear-resistant composite material appropriately secured to the cutting edge of a ground engaging blade have exhibited an excellent wear ratio of approximately ten times that of a conventional steel blade. Thus, the superior qualities of this composite material are further evident.

While the invention has been described and shown with particular reference to a preferred embodiment, it will be apparent that variations might be possible that would fall within the scope of the present invention, which is not intended to be limited except as defined in the following claims.

What is claimed is:

1. A wear-resistant composite material comprising a plurality of abrasive-resistant particles embedded in a matrix consisting essentially of about 3 to 5 percent boron, and the balance being iron having residual impurities.

2. A method of making a ferrous wear-resistant composite article comprising:

placing a plurality of abrasive-resistant shot in a mold, said abrasive-resistant shot being limited in carbon content to less than 0.2% by weight;

depositing a plurality of alloy shot consisting essentially of iron and boron on top of said abrasive-resistant shot, said alloy shot being limited in carbon content to less than 0.2% by weight;

heating said mold in a substantially inert atmosphere to melt said alloy shot and to cause infiltration thereof fully around said abrasive-resistant shot; and cooling and removing such composite article from said mold.

3. The method of claim 2 including the step of using a ceramic mold.

4. The method of claim 3 including the step of introducing a relatively limited amount of nitrogen gas into said atmosphere.

5. A method of making a ferrous wear-resistant composite article for a tool or the like comprising;

placing a plurality of abrasive-resistant shot in a mold;

depositing a plurality of alloy shot consisting essentially of iron and boron on top of said abrasive-resistant shot;

placing said mold in a chamber having an inert atmosphere;

preheating said mold at approximately 1093° C (2000° F) to obtain a uniform temperature of said shot;

subjecting said mold to a final heating stage at approximately 1204° C (2200° F) for a relatively short period sufficient to melt said alloy shot and to cause infiltration thereof embracingly around said abrasive-resistant shot; and cooling and removing such composite article from said mold.

6. The wear-resistant composite material of claim 1 wherein said abrasive-resistant particles are metallic, said metallic particles comprising 45 to 70 percent by volume of the composite material.

7. The wear-resistant composite material of claim 1 wherein said residual impurities include less than 0.2% carbon.

8. The wear-resistant composite material of claim 7 wherein said abrasive-resistant particles are of substantially spheroidal configuration, and said matrix is a eutectic composition of iron and boron.

9. The wear-resistant composite material of claim 8 wherein said spheroidal particles are shot having diameters wherein the range of 0.5 mm to 2 mm.

10. The wear-resistant composite material of claim 8 wherein the material of said spheroidal particles is metallic and limited to less than 0.2% carbon.

* * * * *